US011426860B1

(12) United States Patent
Wolfe

(10) Patent No.: US 11,426,860 B1
(45) Date of Patent: Aug. 30, 2022

(54) EXCAVATOR BREAKER RACK AND METHOD OF USE

(71) Applicant: Paul Allen Wolfe, Springtown, TX (US)

(72) Inventor: Paul Allen Wolfe, Springtown, TX (US)

( * ) Notice: Subject to any disclaimer, the term of this patent is extended or adjusted under 35 U.S.C. 154(b) by 0 days.

(21) Appl. No.: 17/235,698

(22) Filed: Apr. 20, 2021

Related U.S. Application Data

(60) Provisional application No. 63/012,382, filed on Apr. 20, 2020.

(51) Int. Cl.

| | |
|---|---|
| ***A47B 81/00*** | (2006.01) |
| ***A47F 7/00*** | (2006.01) |
| ***B25H 3/04*** | (2006.01) |
| ***B25H 5/00*** | (2006.01) |
| *E02F 3/96* | (2006.01) |

(52) U.S. Cl.
CPC ..... *B25H 3/04* (2013.01); *B25H 5/00* (2013.01); *A47B 81/005* (2013.01); *A47F 7/0028* (2013.01); *E02F 3/966* (2013.01)

(58) Field of Classification Search
CPC .. B25H 3/04; B25H 5/00; E02F 3/966; A47B 81/005; A47F 7/0028; A47F 7/0021
See application file for complete search history.

(56) References Cited

U.S. PATENT DOCUMENTS

| | | | | |
|---|---|---|---|---|
| 1,104,004 | A * | 7/1914 | Rathbone | A24F 9/14 211/70.3 |
| 1,792,612 | A * | 2/1931 | Staley | B25H 1/0007 269/55 |
| 2,122,770 | A * | 7/1938 | Colin | C14B 1/26 211/13.1 |
| 4,427,117 | A * | 1/1984 | Matthewson | B65G 1/14 211/13.1 |
| 5,975,314 | A * | 11/1999 | Lee | B65D 19/44 206/485 |
| 6,170,672 | B1 * | 1/2001 | Boettcher | A47B 81/007 211/13.1 |
| 6,585,224 | B1 * | 7/2003 | Schmidt | B63H 20/36 108/55.1 |
| 7,458,476 | B2 * | 12/2008 | Peoples | B25H 1/12 211/134 |
| 9,452,523 | B2 * | 9/2016 | Hokanson | B25H 3/003 |
| 9,751,472 | B2 * | 9/2017 | Meyers | F04B 17/06 |
| 10,182,653 | B1 * | 1/2019 | Long | A47F 7/0028 |

(Continued)

*Primary Examiner* — Kimberley S Wright
(74) *Attorney, Agent, or Firm* — Leavitt Eldredge Law Firm

(57) ABSTRACT

An excavator breaker storage rack includes a base having a first beam and a second beam running parallel and to rest on a ground surface; a support system attached to the base, the support system having vertical supports extending up from the base; angled supports attached to the base and the vertical supports such that the angled supports are positioned at an angle relative to the base of less than 90 degrees and greater than 10 degrees; one or more base plates attached to and extending away from the one or more angled supports; one or more top plates attached to the one or more angled supports; and one or more arms positioned on opposite sides of the one or more top plates; the support system is to support one or more excavator breakers above the ground surface.

3 Claims, 5 Drawing Sheets

(56) References Cited

U.S. PATENT DOCUMENTS

| | | | | |
|---|---|---|---|---|
| D918,274 | S * | 5/2021 | Hokanson | D15/28 |
| 2004/0007542 | A1* | 1/2004 | Hopkins | B25H 3/04 211/13.1 |
| 2012/0234780 | A1* | 9/2012 | Hokanson | E21B 19/14 211/69 |
| 2014/0263505 | A1* | 9/2014 | Meyers | F04B 17/06 224/401 |
| 2015/0209954 | A1* | 7/2015 | Hokanson | B25H 3/04 52/741.14 |
| 2015/0209955 | A1* | 7/2015 | Hokanson | B25H 3/003 212/270 |
| 2019/0091532 | A1* | 3/2019 | Fenoglio | B60R 9/08 |
| 2020/0386100 | A1* | 12/2020 | Hunt | E21C 35/00 |

* cited by examiner

EXCAVATOR BREAKER RACK AND METHOD OF USE

BACKGROUND

1. Field of the Invention

The present invention relates generally to excavator breaker storage systems, and more specifically, to a storage rack that is configured to hold one or more excavator breakers at an angle of approximately 45 degrees which provides for improved safety and reduces the need for repairs of the excavator breakers.

2. Description of Related Art

Excavator breaker storage systems are well known in the art and provide for storage of excavator breakers when not in use. For example, FIG. 1 depicts a side view of a conventional storage system 101, wherein a pallet 103 is provided for holding a breaker 105 when not in use.

One of the problems commonly associated with system 101 is limited use. For example, holding the breaker at a fully horizontal position is undesirable as it becomes more difficult to attach to an excavator. In other storage systems, the breaker may be held at a completely vertical position which further has drawbacks, such as providing potential for falling over, which is both unsafe and can be damaging to the breaker.

Accordingly, although great strides have been made in the area of excavator breaker storage systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
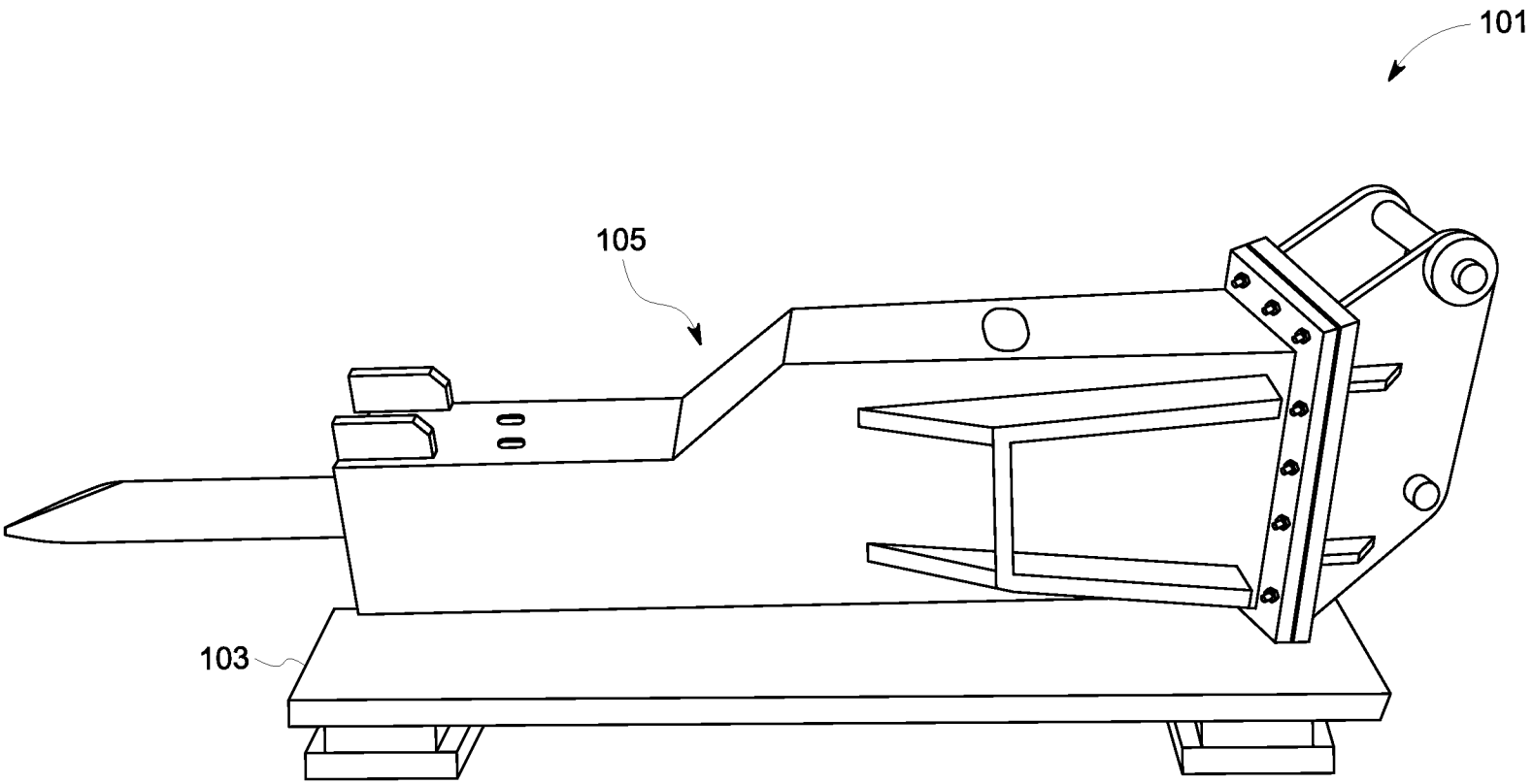
FIG. 1 (PRIOR ART)
FIG. 1 is a side view of a common breaker storage system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional breaker storage systems. Specifically, the present invention provides for a storage rack that is configured to securely hold one or more breakers in an angled orientation, preferably around 45 degrees, thereby limiting the possibility of the breakers falling and becoming damaged. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
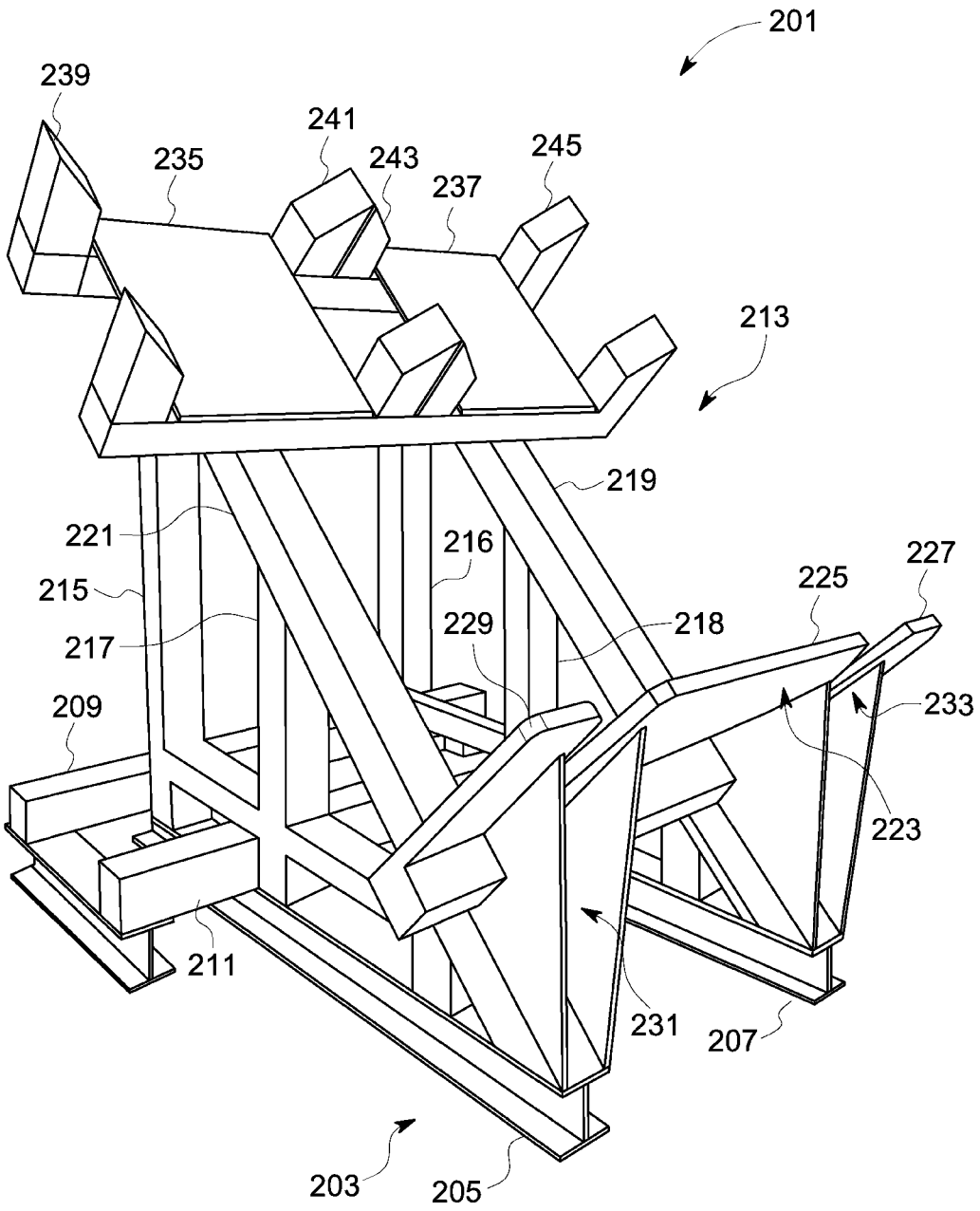
FIG. 2 is an isometric view of a breaker storage rack in accordance with a preferred embodiment of the present application.

Referring now to the drawings wherein like reference characters identify corresponding or similar elements throughout the several views, FIG. 2 depicts an isometric view of an excavator breaker storage rack 201 in accordance with a preferred embodiment of the present application. It will be appreciated that system 201 overcomes one or more of the above-listed problems commonly associated with conventional storage systems.

In the contemplated embodiment, rack 201 includes a base 203 having a first beam 205 and a second beam 207 running parallel and configured to rest on a ground surface. In some embodiments, additional supports 209, 211 are incorporated into the base and extend perpendicular to the beams, thereby providing for additional stability.

Rack 201 further includes a support system 213 that provides for holding the one or more breakers (see FIG. 3) in an angled position. As shown, the support system 213 includes one or more vertical supports 215, 216, 217, 218, 401 that extend upwards from the base and support one or more angled supports 219, 221. It should be appreciated that the rack can be scaled up or down for holding more or fewer breakers.

The support system 213 further includes one or more base plates 223. As shown, in one embodiment, the one or more base plates 223 include a middle portion 225, a first side portion 227, and a second side portion 229, wherein openings 231, 233 are created. In the preferred embodiment, the base plate 223 is a single piece, including the middle 225 and sides 227, 229. System 201 further includes gussets 246, 248, 250, 252 for structural support.

Figure 3:
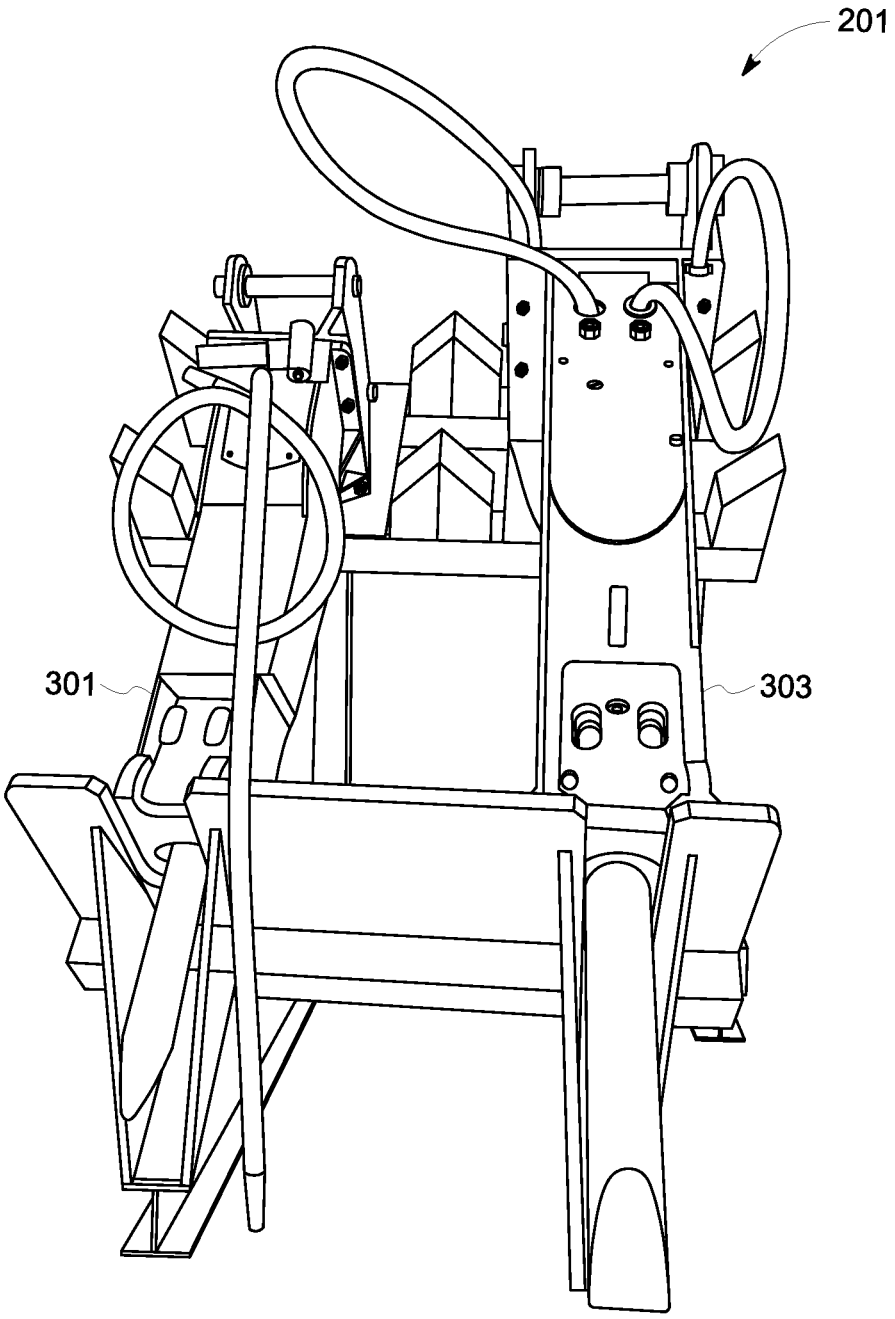
FIG. 3 is an isometric view of the storage rack of FIG. 2 with two breakers stored therein.

The support system 213 further includes one or more top plates 235, 237, each having one or more arms 239, 241, 243, 245 extending therefrom. As shown in FIG. 3, the breakers 301, 303 will lay within the support system such that a top portion of the breaker is supported by the top plate and a bottom portion is supported by the bottom plates.

It should be appreciated that one of the unique features believed characteristic of the present application is the configuration of the rack 201 such that the one or more breakers will be supported at an angle. The angle of support will be between 10 degrees and 90 degrees, but preferably around 45 degrees. This feature allows for safe storage and further allows for easier one-man operation of being able to attach and detach from the cab of the excavator.

Figure 4:
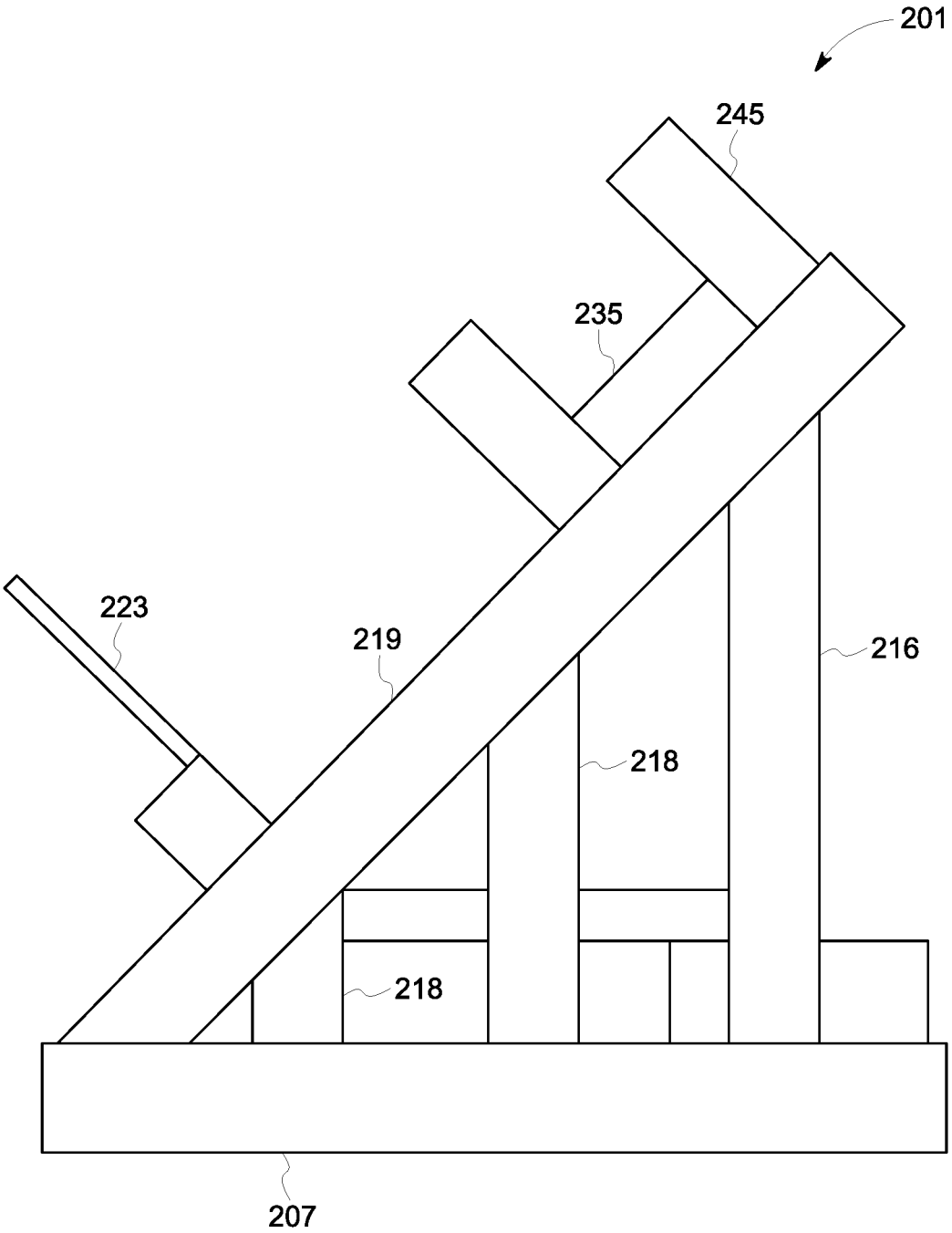
FIG. 4 is a side diagram view of the storage rack of FIG. 2.

In FIG. 4, a side diagram view of rack 201 is shown for clarity. It should be appreciated that additional supporting elements and structural features can be included as necessary without diminishing the novelty or integrity of the present invention.

Figure 5:
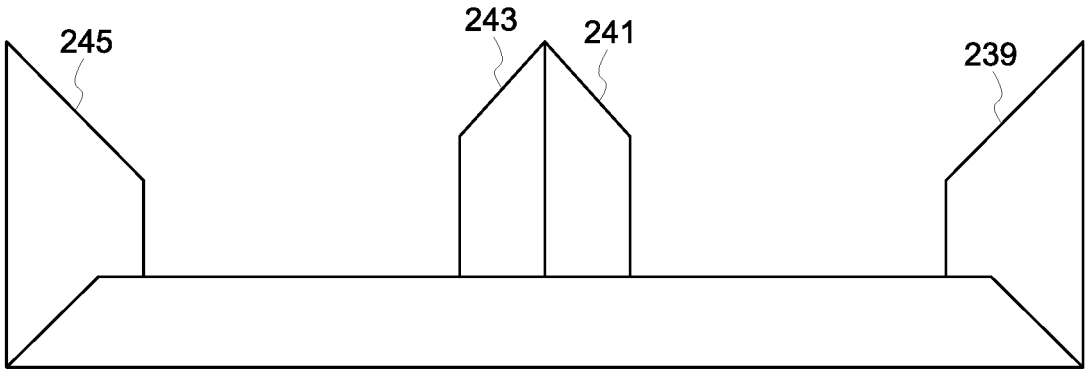
FIG. 5 is a top view depicting orientations of the arms of the storage rack of FIG. 2.

In FIG. 5, a top view further depicts a preferred orientation of the arms 239, 241, 243, 245 for clarity. The arms provide for a cradle for the breakers and prevent falling of the breakers such as if bumped.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An excavator breaker storage rack, comprising:

a base having a first beam and a second beam running parallel to each other and configured to rest on a ground surface;

a support system attached to the base, the support system having:

one or more vertical supports extending up from the base;

one or more angled supports attached to the base and attached to the one or more vertical supports such that the one or more angled supports are positioned at an angle relative to the base of less than 90 degrees and greater than 10 degrees;

one or more base plates attached to and extending away from the one or more angled supports, the one or more base plate having a middle section, a first side section, a second side section, a first opening between the middle section and the first side section, and a second opening between the middle section and the second side section;

one or more top plates attached to the one or more angled supports; and one or more arms positioned on opposite sides of the one or more top plates, the one or more arms having an angled surface;

wherein the support system is configured to support one or more excavator breakers above the ground surface.

2. The rack of claim 1, wherein the angle is approximately 45 degrees.

3. The rack of claim 1, wherein the base further comprises:

one or more secondary supports running perpendicular to the first beam and the second beam.

* * * * *